US006799606B1

(12) United States Patent
Howson

(10) Patent No.: US 6,799,606 B1
(45) Date of Patent: Oct. 5, 2004

(54) DRAINAGE PIPE COVERING KIT FOR USE DURING BUILDING OR FLOOR CONSTRUCTION

(76) Inventor: Leslie Lawrence Howson, 28 Sunset Boulevard, Surfer's Paradise, Queensland 4217 (AU)

( * ) Notice: Subject to any disclaimer, the term of this patent is extended or adjusted under 35 U.S.C. 154(b) by 0 days.

(21) Appl. No.: 10/088,887

(22) PCT Filed: Sep. 25, 2000

(86) PCT No.: PCT/AU00/01168

§ 371 (c)(1),
(2), (4) Date: Sep. 12, 2002

(87) PCT Pub. No.: WO01/23680

PCT Pub. Date: Apr. 5, 2001

(30) Foreign Application Priority Data

Sep. 24, 1999 (AU) ..... PQ3083
Nov. 10, 1999 (AU) ..... 59308/99
Dec. 8, 1999 (AU) ..... PQ4547

(51) Int. Cl.[7] ..... F16L 55/10

(52) U.S. Cl. ..... 138/96 R; 138/89; 215/317; 285/4; 4/501; 210/164

(58) Field of Search ..... 138/96 R, 96 T, 138/89, 89.1, 89.4, 252.4, 252.5, 501, 504; 4/252.4, 252.5, 501, 504; 285/4; 220/780, 784; 215/317, 321, 43; 210/164

(56) References Cited

U.S. PATENT DOCUMENTS 3,311,391 A * 3/1967 Harrell ..... 285/58
3,800,486 A * 4/1974 Harvey ..... 52/98
4,212,486 A * 7/1980 Logsdon ..... 285/4
4,883,590 A * 11/1989 Papp ..... 210/164
5,377,361 A * 1/1995 Piskula ..... 4/252.4
5,921,282 A 7/1999 Castillo ..... 138/89
5,996,134 A * 12/1999 Senninger ..... 4/252.4
6,076,559 A * 6/2000 Castillo et al. ..... 138/89
6,085,362 A * 7/2000 Huber ..... 4/252.4
6,092,244 A * 7/2000 Rizzardi et al. ..... 4/286
6,595,243 B2 * 7/2003 Tarr ..... 138/96 R

FOREIGN PATENT DOCUMENTS

| | | |
|---|---|---|
| AU | 52071/98 | 7/1998 |
| DE | 3620132 | 9/1987 |
| DE | 3819173 | 12/1989 |
| DE | 4329652 | 3/1995 |
| DE | 4411521 | 10/1995 |
| EP | 51316 | 5/1982 |
| GB | 2331529 | 5/1999 |

* cited by examiner

*Primary Examiner*—Patrick Brinson
(74) *Attorney, Agent, or Firm*—Gottlieb, Rackman & Reisman, P.C.

(57) ABSTRACT

An accessory for use in construction includes a conduit (12) that has an inlet end (34) portion and an outlet end (18) portion. The outlet end (18) portion is mountable on a drainage pipe (22) so that the conduit (12) and the drainage pipe (22) are in fluid communication with each other. A removable closure member (40) is mounted on the inlet end (34) portion to close the conduit (12) when not in use or during building construction, so that ingress of material or detritus into the drainage pipe (22) is inhibited.

11 Claims, 11 Drawing Sheets

DRAINAGE PIPE COVERING KIT FOR USE DURING BUILDING OR FLOOR CONSTRUCTION

This invention relates to drainage pipes. More particularly, this invention relates to an accessory for use in construction, to a drainage kit and to a method of construction.

Conventionally, drainage pipes are usually positioned in a substrate to be flush with or to extend partially from the substrate. Once this has been done, a layer of screed is formed on the substrate. A bed of tiles may or may not then be positioned on the screed. It has been found that, during construction, screed material is often disposed of in the drainage pipe. Where tiles are layed on the screed layer, the tiles are broken off at a region about the drainage pipe to provide a location in which a drain grate can be positioned. These pieces of broken tile are often also disposed of in the drainage pipe.

The waste screed and tile pie can cause substantial problems at a later stage. In fact, it is well known in the plumbing trade that initial call backs on new buildings are usually due to blockages resulting from material disposed of in the drainage pipes.

A problem presently facing tilers is the provision of a level mark which the tiler can use to determine the thickness of screed to be placed on the substrate. At present, tilers have a difficultly in achieving a consistently level surface of screed because of the lack of a central mark that they can use as a reference point.

It will be appreciated that it would be desirable for a means to be provided whereby the above issues can be addressed.

According to a first aspect of the invention, there is provided an accessory for use in construction, the accessory including

- a conduit that has an inlet end portion and an outlet end portion. the outlet end portion being mountable on a drainage pipe so that the conduit and the drainage pipe are in fluid communication with each other; and
- a removable closure member which is mounted on the inlet end portion to close the conduit when not in use so that the ingress of detritus into the drainage pipe is inhibited.

The accessory may include a reference level arrangement that is positioned on the conduit and is configured so that when the conduit is mounted on the drainage pipe, the reference level arrangement provides at least a reference level for a thickness of a screed layer to be formed on a substrate.

The conduit may be circular cylindrical. The inlet end portion of the conduit may be of an enlarged diameter. Further, a distance between a shoulder defined at a junction between the inlet end portion and a remaining portion of the conduit and an end of the inlet end portion may be at least substantially equivalent to a desired thickness of a screed layer, so that the inlet end portion defines the reference level arrangement.

The removable closure may be connected to the inlet end portion by a zone of weakness to facilitate separation of the closure from the inlet end portion.

The inlet end portion may have a plurality of openings defined therein to permit drainage of excess water collected about the inlet end portion.

The accessory may include a grate member that is received in the inlet end portion, once the closure has been removed. The grate member may be an assembly of a grate frame and a grate element. The grate frame may define an inwardly extending lip on which the grate element is supported, while the grate element may define a shoulder that bears against the lip of the grate frame.

The accessory may be of a plastics material.

The accessory may include a sealing member having a flange portion and a body portion. The body portion may define a passage in which the conduit is received and the flange portion may be positioned to extend radially from the conduit when the conduit is received in the passage. The conduit and the body portion may be attachable to a drain pipe positioned in a substructure, with the flange portion overlying an upper surface of the substructure.

The sealing member may be of a suitable sealing material such an elastomeric material.

According to a second aspect of the invention, there is provided a drainage kit, the kit including

- a conduit that has an inlet end and an outlet end;
- a removable closure that is mounted on the inlet end of the conduit to close the conduit when not in use; and
- a sealing member having a flange portion and a body portion that defines a passage, the conduit being mountable to the body portion so that the outlet end of the conduit and the passage are in fluid communication with each other.

According to a third aspect of the invention, there is provided a method of construction, the method including the steps of

- mounting a conduit on a drainage pipe, the conduit having an inlet end portion and an outlet end portion so that the conduit and the drainage pipe are in fluid communication with each other, the inlet end portion having a removable closure member to close the conduit when not in use so that the ingress of detritus into the drainage pipe is inhibited;
- removing the closure member; and
- positioning a grate member in the inlet end portion, once the closure has been removed.

An accessory in accordance with this invention may manifest itself in a variety of forms. It will be convenient hereinafter to describe in detail preferred embodiments of the invention with reference to the accompanying drawings. The purpose of this specific description is to instruct persons having an interest in the subject matter of the invention how to carry the invention into practical effect. It is to be clearly understood, however, that the specific nature of this description does not supersede the generality of the preceding broad description. In the drawings.

Figure 1:
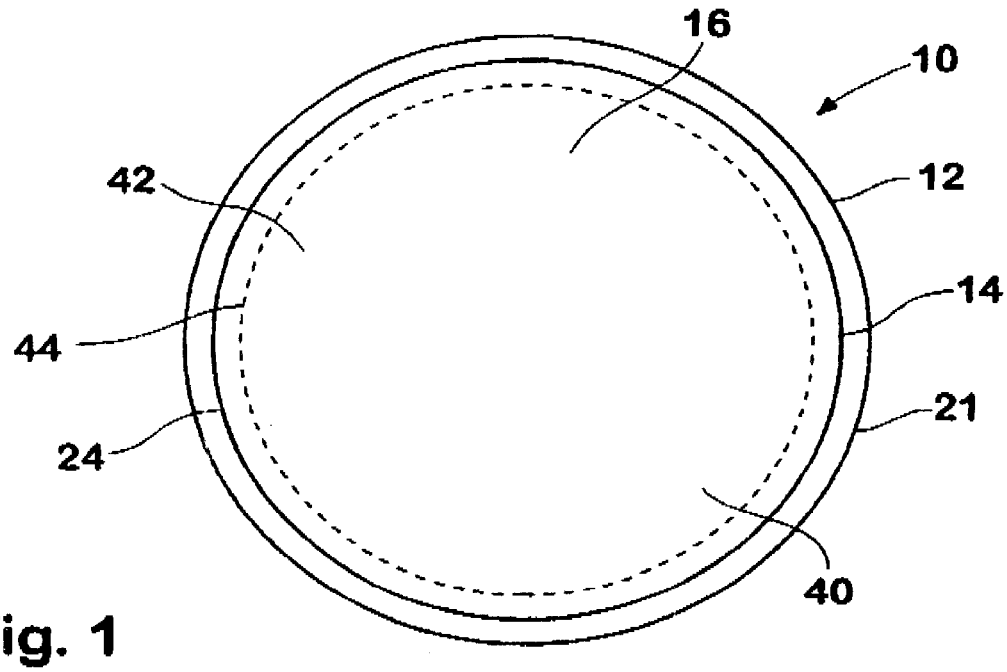
FIG. 1 shows a plan view of a first embodiment of an accessory, in accordance with the invention, for use in construction.
Figure 2:
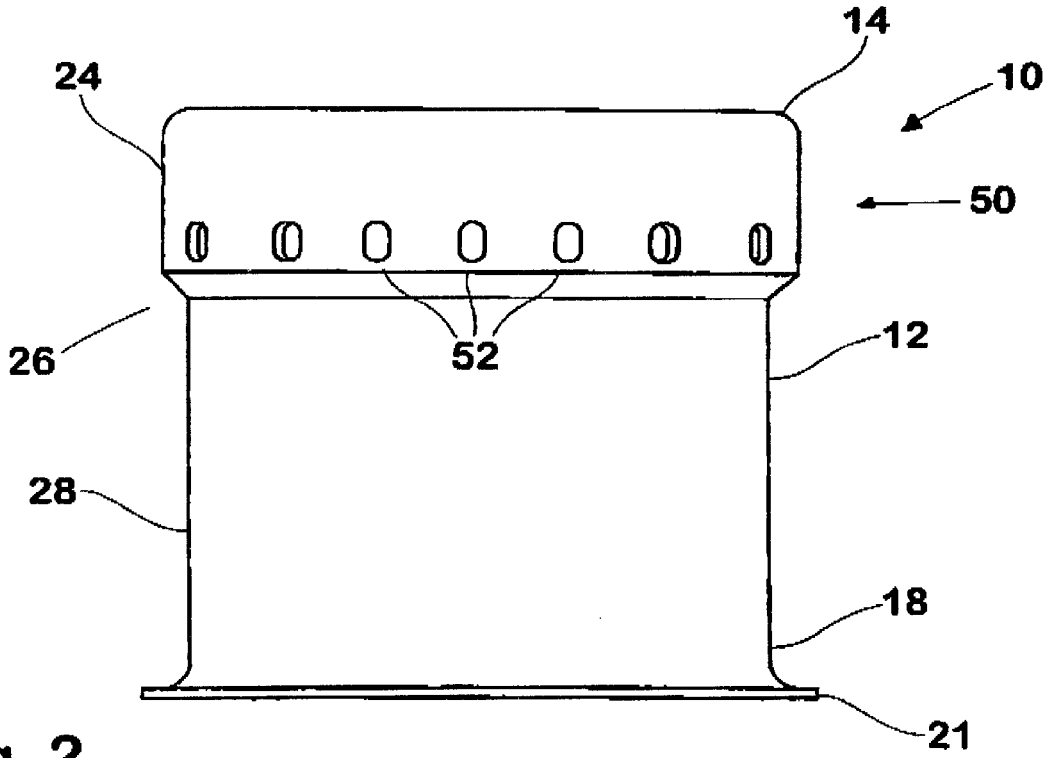
FIG. 2 shows a side view of the accessory of FIG. 1.
Figure 3:
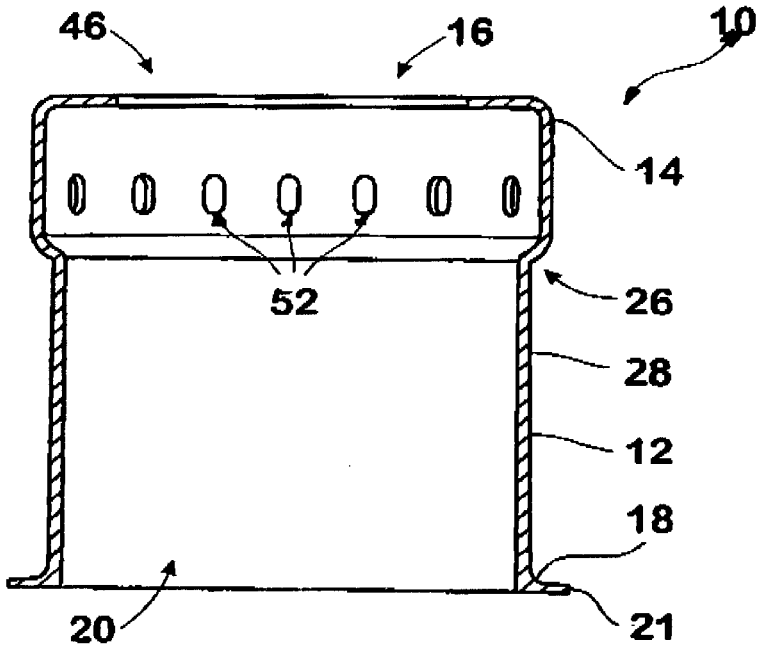
FIG. 3 shows a side sectioned view of the accessory of FIG. 1. without a closure piece.
Figure 4:
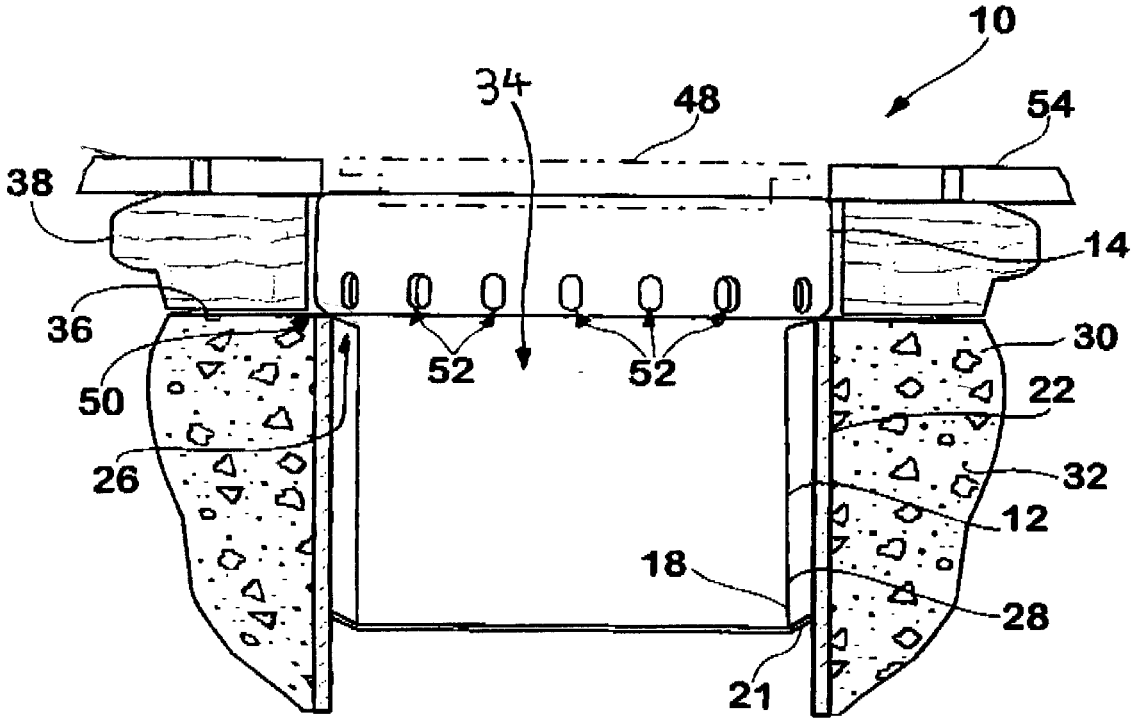
FIG. 4 shows the accessory of FIG. 1 in a typical application.

In FIGS. 1 to 4, reference 10 generally indicates an accessory, in accordance with the invention, for use in construction. The accessory 10 includes a conduit 12. The conduit 12 has an inlet end portion 14 which defines an inlet 16 and an outlet end portion18 which defines an outlet 20.

The outlet end portion 18 has a radially extending flexible lip 21 defined thereon. The lip 21 is dimensioned to be deformed when the conduit 12 is inserted into a drainage pipe 22. Furthermore, the flexible lip 21 is of sufficient resilience to result in the conduit 12 being retained in position in the drainage pipe 22.

The conduit 12 is circular cylindrical with the inlet end portion 14 being of an increased diameter. It follows that a shoulder 26 is defined between the end portion 14 and a remaining portion 28 of the conduit 12.

As is well known in the field, the drainage pipe 22 is mounted in a substrate 30 which, in this case, is in the form of concrete 32. The inlet end portion 14 has a diameter that is greater than that of the drainage pipe 22.

The conduit 12 is inserted, outlet end 18 first, into an inlet 34 of the drainage pipe 22 The conduit 12 is inserted so that the shoulder 26 bears against an upper surface 36 of the concrete substrate 30.

A length of the inlet end portion 14 is equivalent to a thickness of screed 38 to be formed on the substrate 30 Thus, the inlet end portion 14 defines a reference level means whereby a filer can use the inlet end portion 14 as a reference for laying the screed 38.

A removable closure 40 is mounted on the inlet end portion 14 via a zone of weakness 44. The zone of weakness 44 permit and facilitates the removal of the closure piece 42 from the remainder of the conduit 12.

A resultant opening 46 following removal of the closure piece 42 is dimensioned so that a drain grate 48 can be fitted in the opening 46.

A lower region 50 of the inlet end portion 24 has a plurality of openings 52 defined therein. The openings 52 are positioned to be substantially in alignment with the upper surface 36 of the substrate 30.

The accessory 10 is in the form of a unitary one piece structure. Further, the accessory 10 is manufactured from a resilient plastics material, such as a polyvinylchloride.

In use, the conduit 12 is inserted, outlet end 18 first, into the drainage pipe 22 until the shoulder 26 bears against the inlet 34 of the drainage pipe 22 or the upper surface 36 of the substrate 30. A tiler can then lay the screed 38 on the concrete 32 using the inlet end portion 14 as a guide to the thickness of the screed 38 to be laid. A layer of tiles 54 is then laid on the screed 38. Both the screed 38 and the tiles 54 are laid in a conventional fashion.

The tiles are then cut at the location of the drainage pipe 22 to accommodate the drain grate 48. Once the area has been cleaned of screed material and tile chips, the removable closure 40 is removed. The drain grate 48 is then fixed in place, in a conventional manner.

Figure 5:
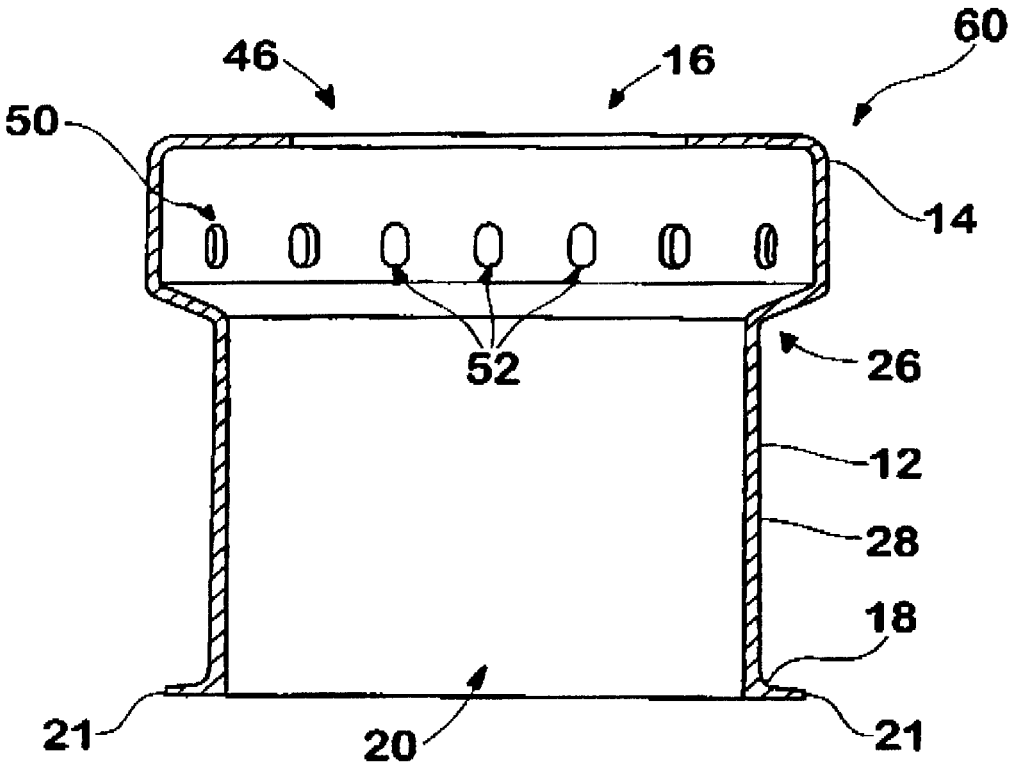
FIG. 5 shows a side sectioned view of a second embodiment of an accessory, in accordance with the invention, for use in construction.
Figure 6:
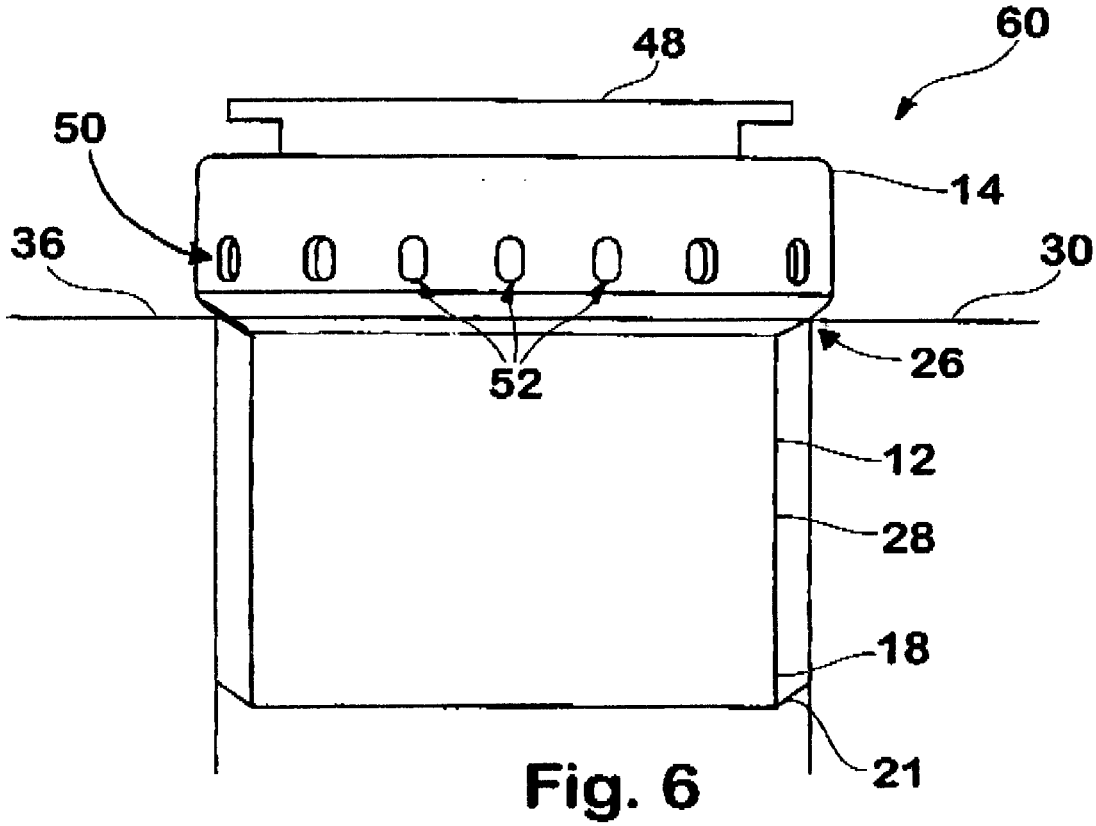
FIG. 6 shows a side view of the accessory of FIG. 5 in a typical application.

In FIGS. 5 and 6, reference numeral 60 generally indicates a second embodiment of an accessory, in accordance with the invention, for use in construction. With reference to FIGS. 1 to 4, like reference numerals refer to like parts, unless otherwise specified.

A primary difference between the accessory 10 and the accessory 60 are the relative dimensions of the inlet end portion 24 and the remaining portion 28. This is clear from the drawings.

Figure 7:
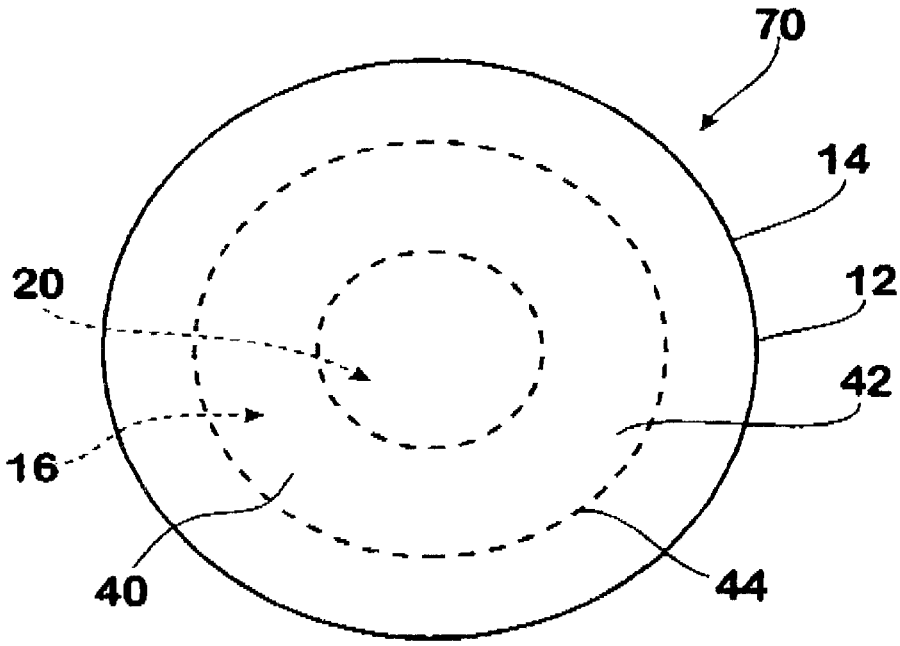
FIG. 7 shows a plan view of a third embodiment of an accessory, in accordance with the invention, for use in construction.
Figure 8:
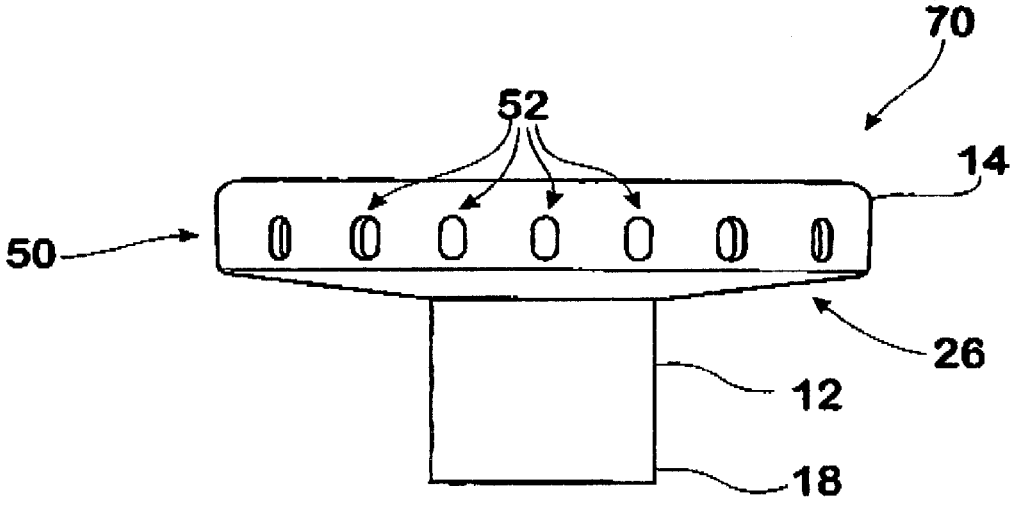
FIG. 8 shows a side view of the accessory of FIG. 7.

In FIGS. 7 and 8, reference numeral 70 generally indicates a third embodiment of an accessory, in accordance with the invention, for use in construction. With reference to FIGS. 1 to 6, like reference numerals refer to like parts, unless otherwise specified.

Again, a primary difference between the accessories 10, 60 and the accessory 70 are the relative dimensions of the inlet end portion 24 and the remaining portion 28. This is clear from the drawings.

Figure 9:
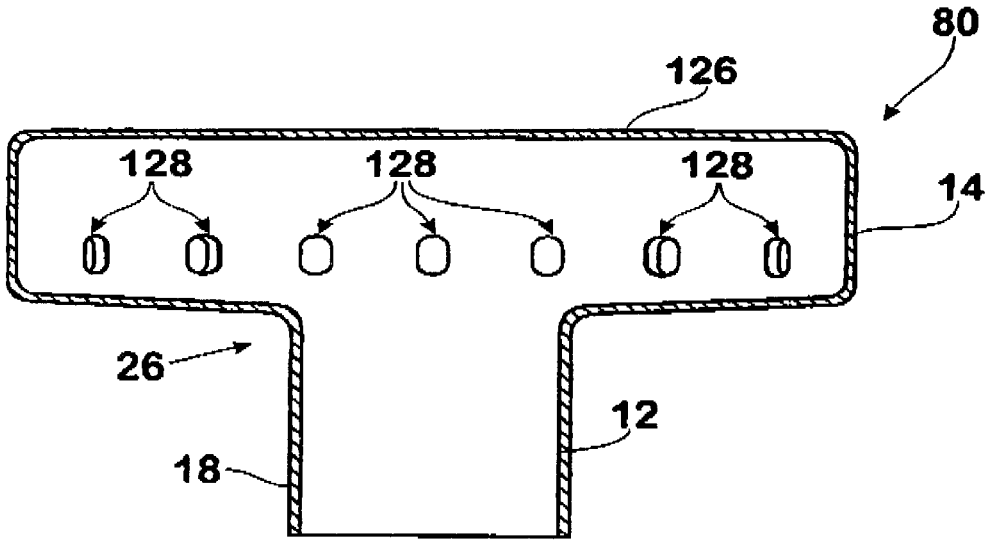
FIG. 9 shows a conduit for a fourth embodiment of a drainage accessory, in accordance with the invention.
Figure 10:
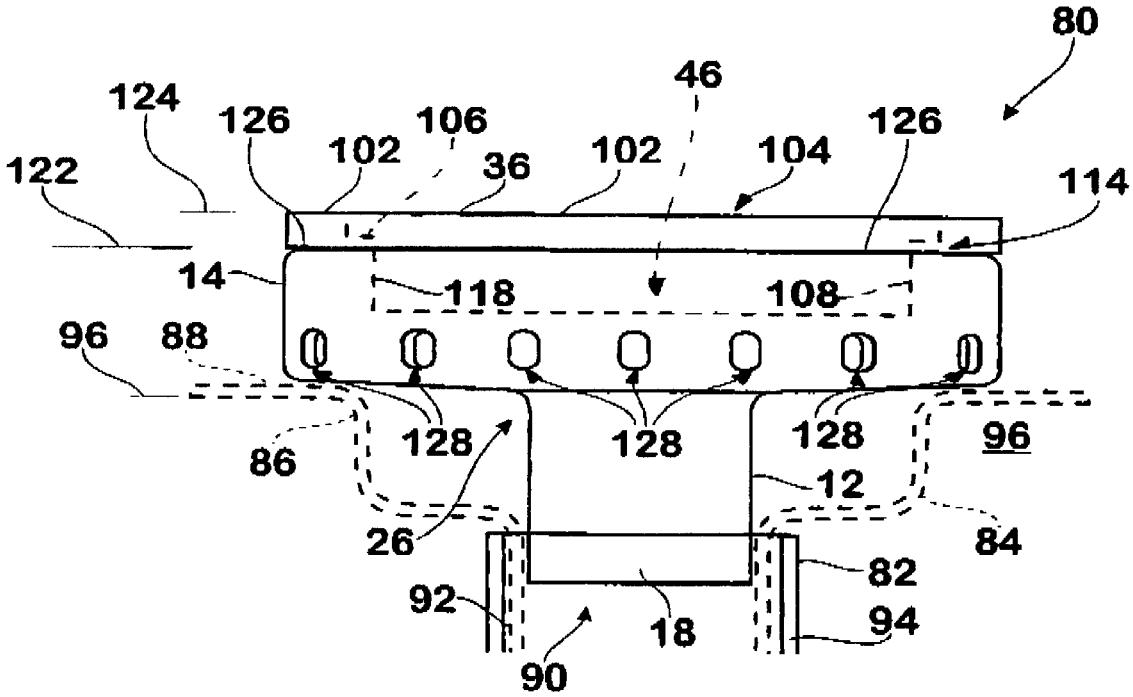
FIG. 10 shows a schematic side view of the drainage accessory of FIG. 9.

In FIG. 10, reference 80 generally indicates a further embodiment of a drainage accessory, in accordance with the invention. With reference to FIGS. 1 to 8, like reference numerals refer to like parts, unless otherwise specified. The conduit 12 of the accessory 80 is shown in FIG. 9.

The accessory 80 is mounted on an existing drainpipe 82. The accessory 80 includes a seal member or puddle flange 84. The puddle flange 84 includes a body portion 86 and a flange portion 88.

The body portion 86 defines a passage 90. A lower end portion 92 of the body portion 186 is received in the drainpipe 82.

The outlet end portion 18 of the conduit 12 is received in the drainpipe 82. The lower end portion 92 of the body portion 86 of the puddle flange 84 is sandwiched between the outlet end portion 18 of the conduit 12 and a wall 94 of the drainpipe 82.

The puddle flange 84 is dimensioned so that, when the lower end portion 92 of the puddle flange 84 is in position, the flange portion 88 overlays a region of a substructure in the form of a slab 96 surrounding the drain pipe 82.

The inlet end portion 14 is dimensioned so that the shoulder 28 bears against the flange portion 88 of the puddle flange 84 so that the flange portion 88 is sandwiched between the shoulder 26 and the slab 96.

The puddle flange 84 is of a suitable sealing material, and, in particular, is of an elastomeric material. This provides a sealing effect between the slab 96 and the inlet end portion 14.

Figure 11:
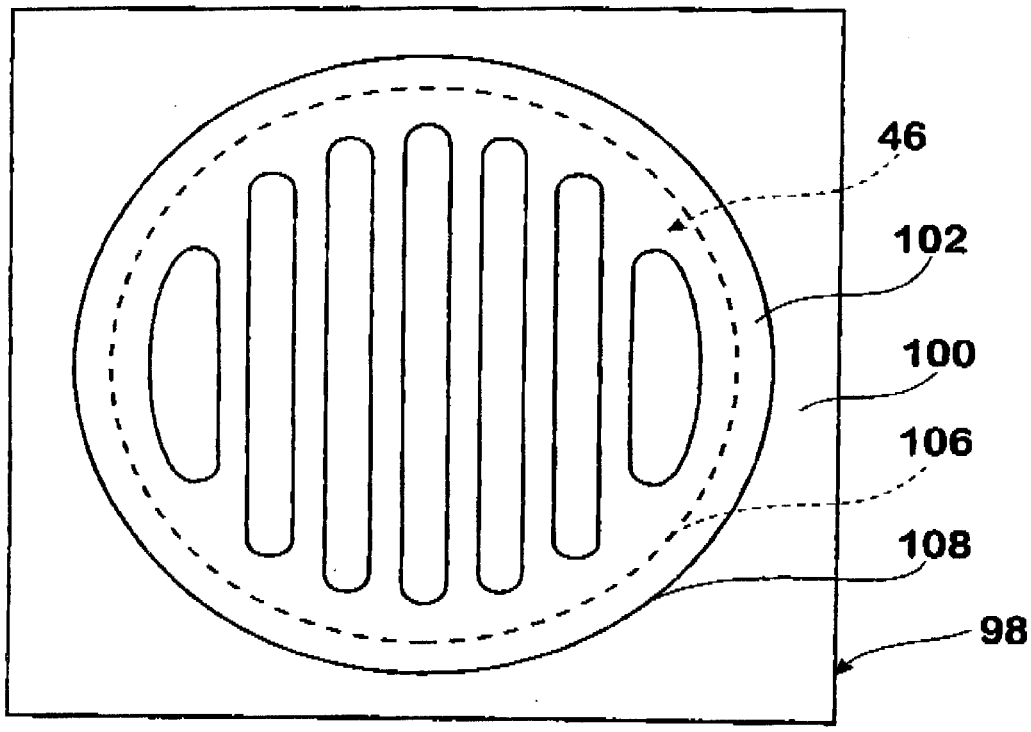
FIG. 11 shows one embodiment of a grate of a drainage kit, also in accordance with the invention.
Figure 12:
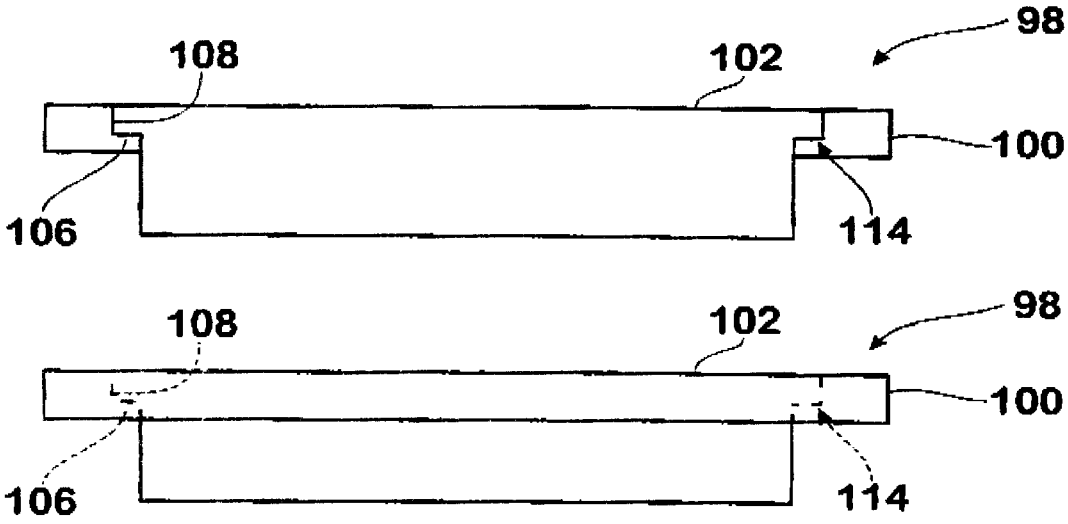
FIG. 12 shows a schematic side view of the grate.
Figure 13:
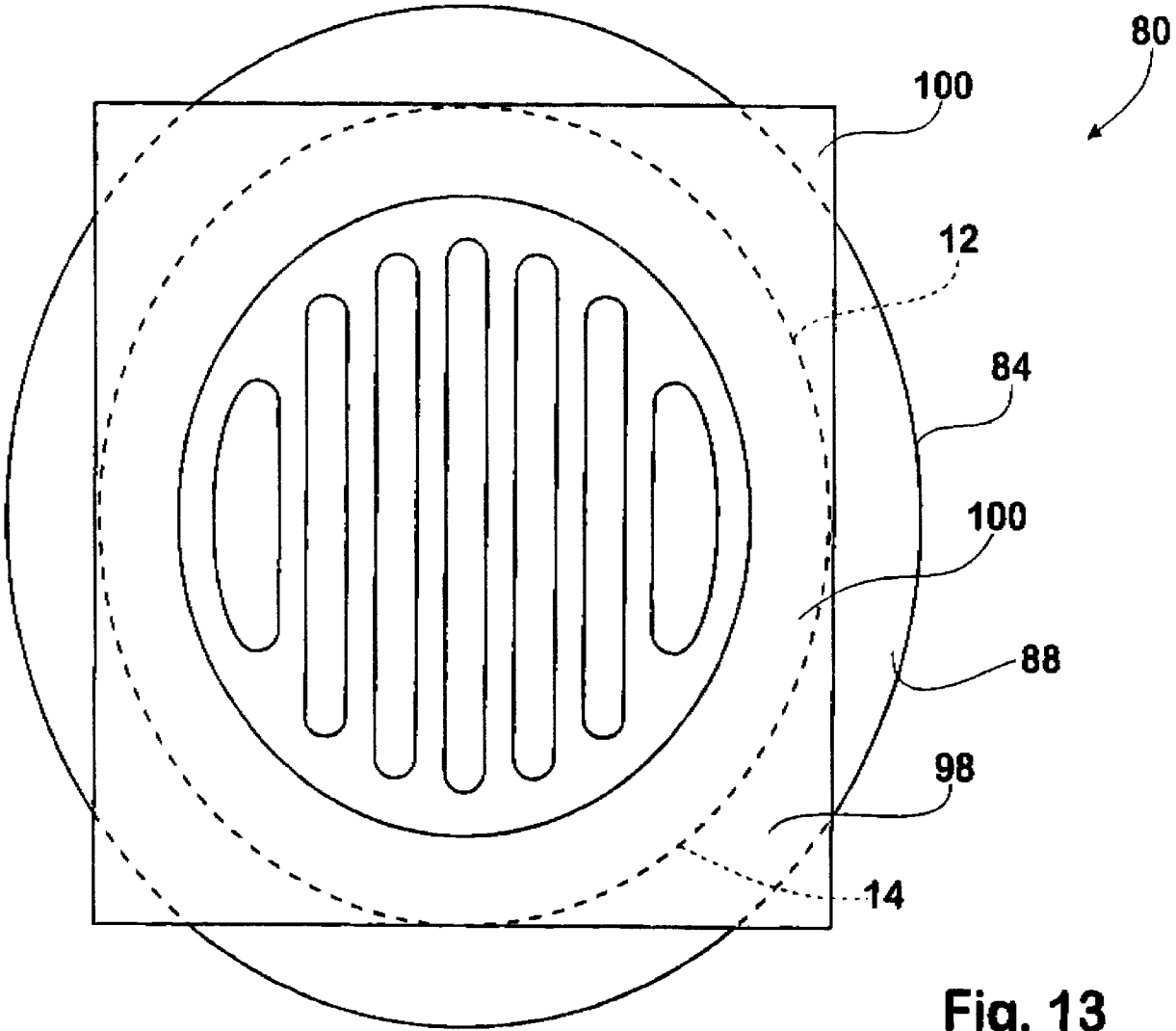
FIG. 13 shows a plan view of the grate, in position.

In FIGS. 11, 12 and 13, there is shown a grate 98 in accordance with the invention. The grate 98 is an assembly of a grate frame 100 and a grate element 102.

The grate frame 100 is rectangular and defines a circular opening 104. In particular, the grate frame 100 defines an inwardly extending lip 106 positioned on a periphery 108 of the opening 104.

The grate element 100 has a circular cylindrical body 110 that is dimensioned to fit snugly through the opening 104. An upper end portion 112 of the grate element 100 has an enlarged diameter so that a shoulder 114 is defined at a junction between the upper end portion 112 and the remainder of the body 110. The shoulder 114 is positioned to bear against the lip 106, in use. Furthermore, the upper end portion 112 is of a suitable thickness so that the grate element 102 is flush with the grate frame 100.

Figure 14:
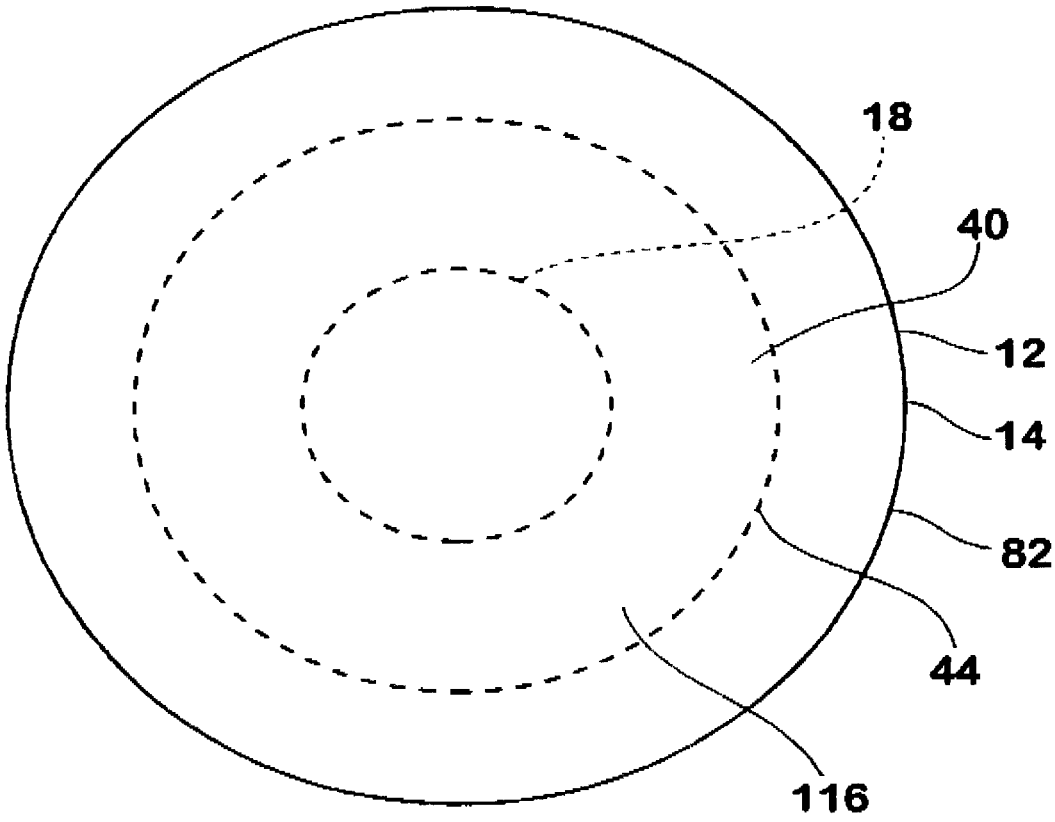
FIG. 14 shows a plan view of a conduit of the kit.
Figure 15:
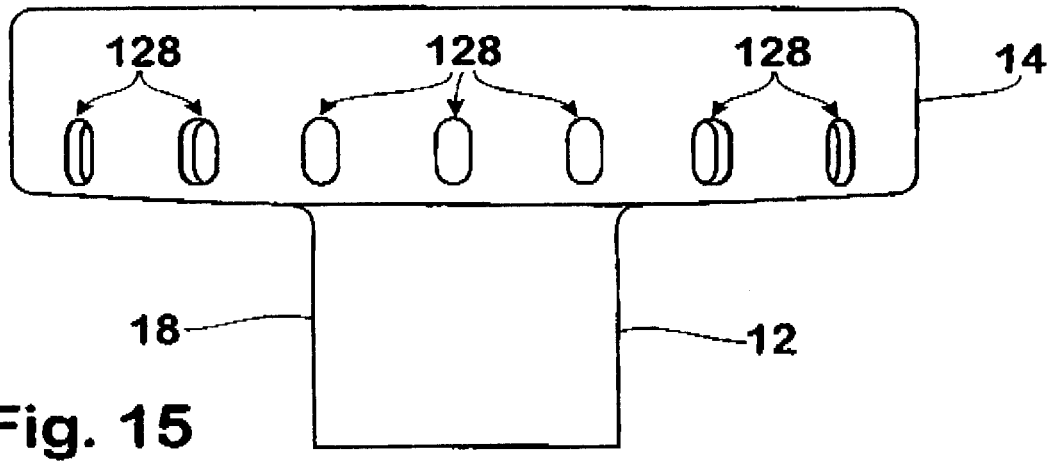
FIG. 15 shows a side view of the conduit of FIG. 14.
Figure 16:
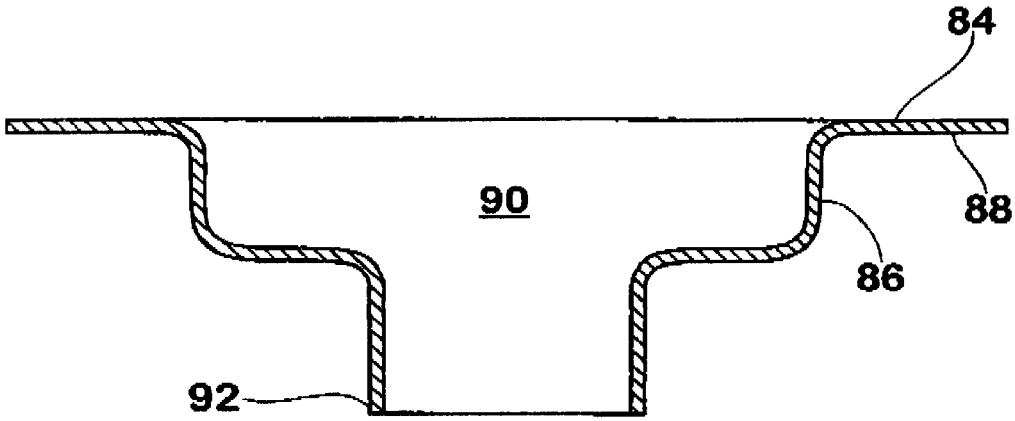
FIG. 16 shows a side sectioned view of a seal member of the kit.

As can be seen in FIG. 14, the removable closure 40 is in the form of a blank 116 connected to the conduit 12 via the zone of weakness 44. The zone of weakness 44 is such that cutting of the blank 116 away from the conduit 12 is facilitated. The zone of weakness 44 is circular and demarcates a cross sectional area that is equivalent to a cross sectional area of a lower portion 118 of the grate element 102.

Figure 18:
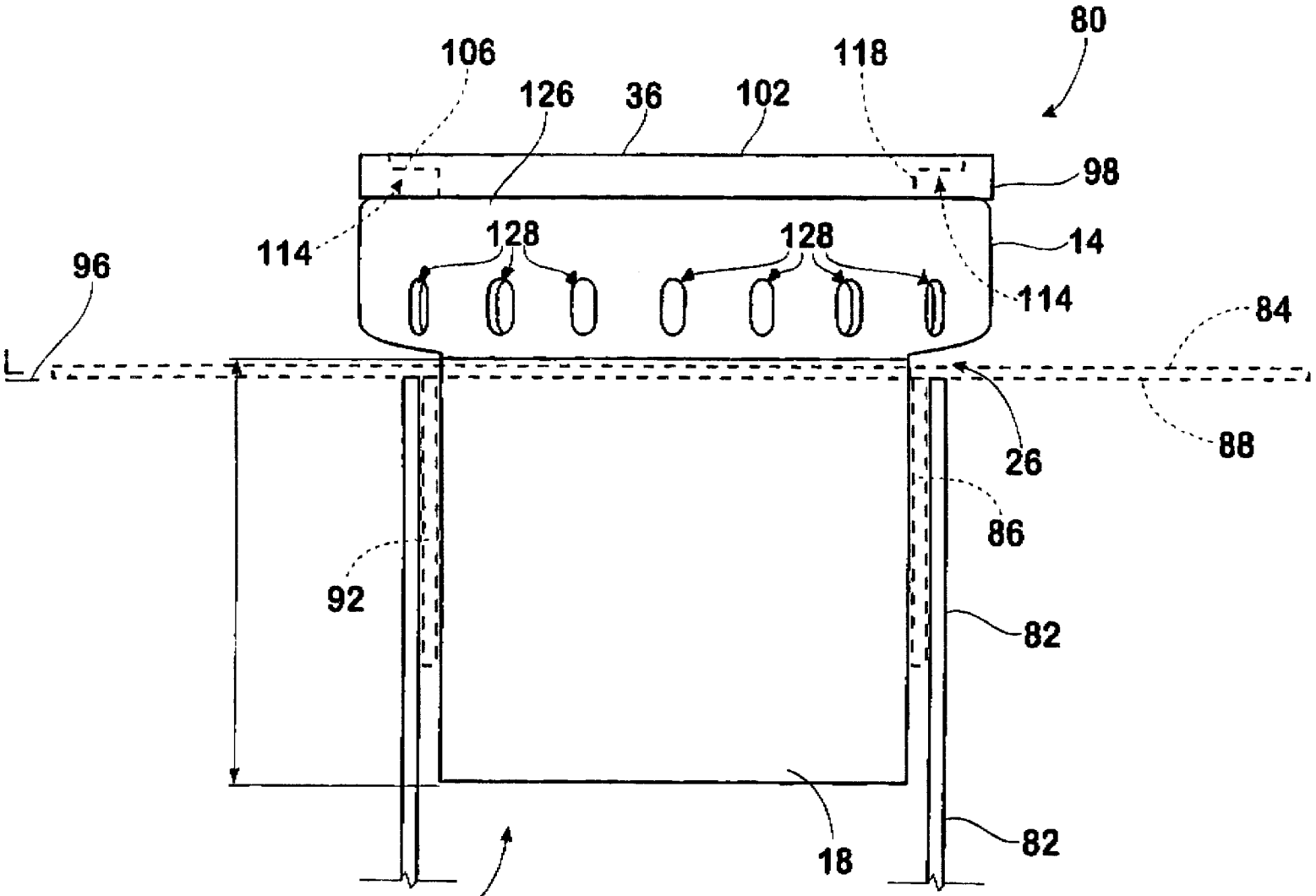
FIG. 18 shows a side view of another embodiment of the accessory.

As can be seen in FIG. 10 and FIG. 18, the grate frame 100 rests on top of the enlarged inlet end portion 24. In this position, the grate element 102 extends downwardly through the resultant opening 48 that is defined when the removable closure 40 is removed.

In a floor structure, there is provided a slab level 120, a bedding level 122 and a tile level 124. The thickness of the inlet end portion 14 is such that the height of bedding to be laid on the slab 96 corresponds with the height of an upper surface 126 of the inlet end portion 14 when the inlet end portion 14 is in position.

A thickness of the grate frame 100 corresponds to a distance between the bedding level 122 and the tile level 124.

It will therefore be appreciated that the inlet end portion 14 serves as a reference level for a tiler laying the bedding.

Once the bedding has been laid, the tiles are placed on the bedding. The tiles are then cut and shaped to suit the grate 98. The area is then cleaned of any debris. The closure 40 is then cut away from the inlet end portion 14. The grate 98 is placed as shown in FIGS. 10 and 18. The fact that the thickness of the grate frame 100 corresponds to the distance between the bedding level 122 and the tile level 124 serves to provide a substantially flush finish Tiles are usually rectangular. Thus, the rectangular grate frame 100 facilitates accurate cutting of the tiles and reduces the amount of time spent by a tiler in correctly shaping the tiles in the region of the drainage accessory 80.

A plurality of drainage openings 128 are defined in the inlet end portion 14 proximate the shoulder 26. The drainage openings 128 are positioned so that, when the conduit 12 is in position on the drain pipe 82 and prior to the bedding and the tiles being laid, any water accumulating in the region of the drainpipe 82 is drained away via the openings 128.

The drainage accessory 80 can be supplied in the form of a kit, also in accordance with the invention. The kit can include the conduit 12 and the puddle flange 84. In addition to the conduit 12 and puddle flange 84, the kit can also include the grate 98. It will thus be appreciated that the puddle flange 84 will be particularly shaped to suit the conduit 12. Still further, the grate 98 will also be shaped and configured to suit the conduit 12.

A particular advantage of providing the accessory 80 in the form of a kit is that a plumber will be in a position to install all the components necessary for drainage without having to source various components from different suppliers.

The conduit 12 and the grate frame 100 are of a plastics material.

Figure 17:
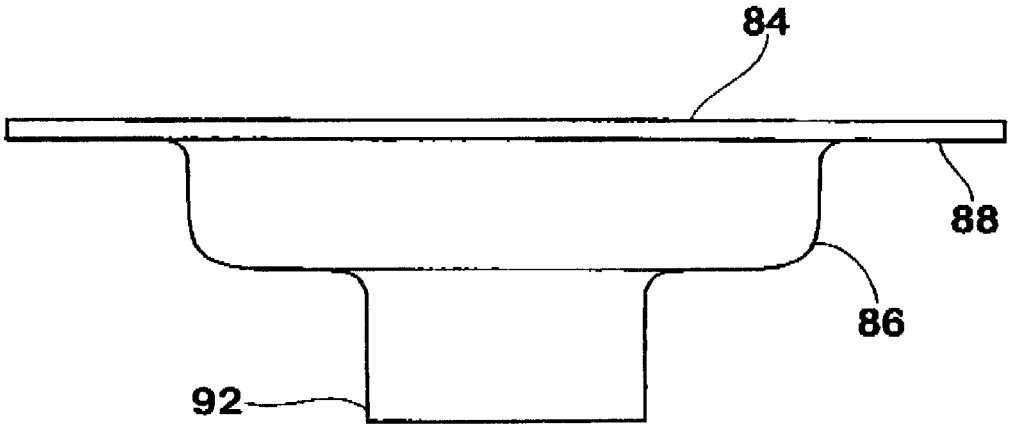
FIG. 17 shows a side view of the seal member of FIG. 16.
Figure 19:
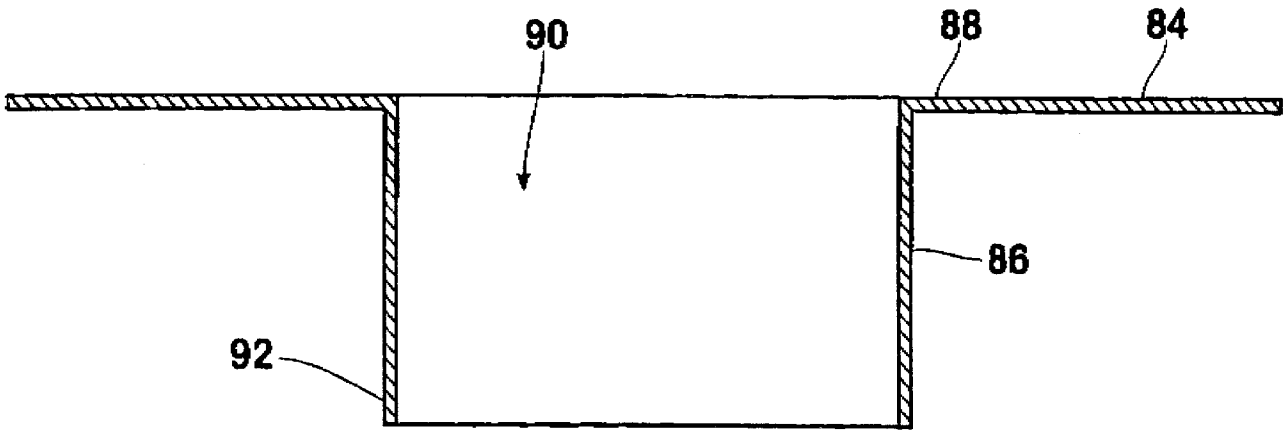
FIG. 19 shows a side sectioned view of another embodiment of a seal member for use with the embodiment of FIG. 18.
Figure 20:
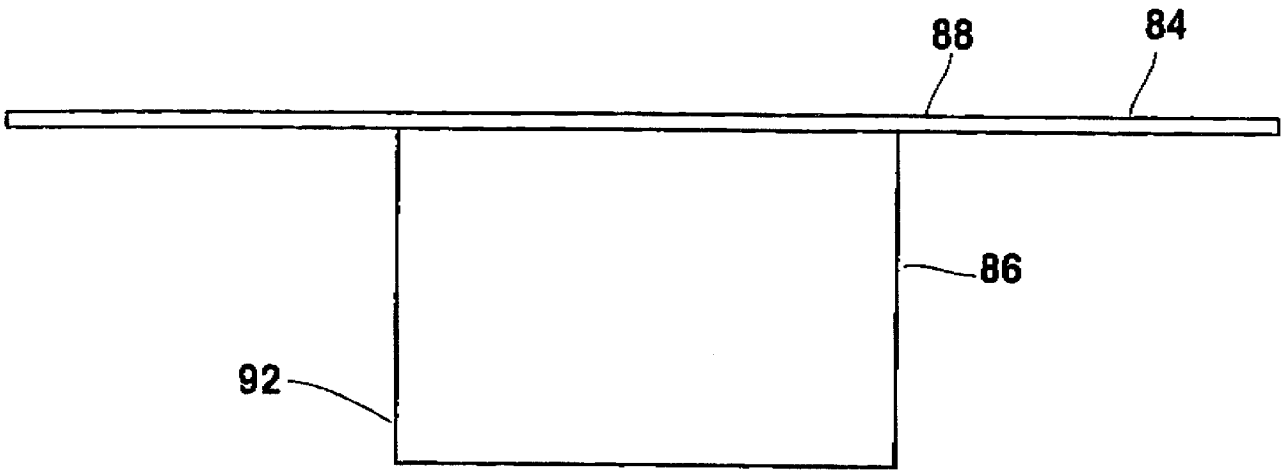
FIG. 20 shows a side view of the seal member of FIG. 19.

In the example described above and as can be seen in the drawings, the conduit 12 is provided in two different sees. It follows that the puddle flange 84 is also provided in two different configurations. One of the configurations is shown in FIGS. 10 and 17, while the other configuration is shown in FIGS. 19 and 20. It should be noted that the invention is in no way restricted to these two sizes and that they have been given only by way of illustration.

Further, the puddle flange 84 can be dimensioned so that the lower end portion 92 can either fit over an end of one form of standard drainpipe or within an end of another form of standard drainpipe.

As has been set out earlier, a major problem with the construction of floors incorporating drainage outlets is that screed material and pieces of tile are often disposed of in the drainpipe. In addition, various other items of waste such as empty cement packets are often used to block drainpipes, to prevent disposal of waste materials during construction in the drainpipes. The empty cement packets themselves then cause substantial plumbing problems. The blockage of drainpipes as a result of this sort of activity is one of the main reasons for a plumbers first call out on a new construction.

One of the significant advantages of this invention is that screed material and tiles are inhibited from entering the drainage pipe 22. This is as a result of the removable closure being left in place until such time as it becomes necessary to mount the drain grate 98.

It will of course be realised that the above has been given only by way of illustrative example of the invention and that all such modifications and variations thereto as would be apparent to persons skilled in the art are deemed to fall within the broad scope and ambit of the invention as is herein set forth.

What is claimed is:

1. An accessory for use in construction, and mountable on a drainage pipe extending above a substrate, the accessory comprising:

a conduit that has an inlet end portion and an outlet end portion, the outlet end portion being mountable on a drainage pipe so that the conduit and the drainage pipe are in fluid communication with each other, the inlet end portion having an enlarged diameter to define a shoulder at a junction of the inlet and outlet portions so that, when the outlet end portion is mounted on the drainage pipe, the shoulder bears against said substrate, a length of the inlet portion corresponding to a thickness of a screed layer to be formed on the substrate such that the inlet end portion defines a reference level arrangement for the screed layer; and a removable closure member which is mounted on the inlet end portion to close the conduit when not in use so that the ingress of detritus into the drainage pipe is inhibited, the inlet end portion and the removable closure member being configured so that, when the closure member is removed, a grate member can be fitted in the resultant opening.

2. An accessory as claimed in claim 1, in which the removable closure is connected to the inlet end portion by a zone of weakness to facilitate separation of the closure from the inlet end portion.

3. An accessory as claimed in claim 1, in which end portion has a plurality of openings defined therein to permit drainage of excess water collected about the inlet end portion.

4. An accessory as claimed in claim 1, which includes a grate member that is received in the inlet end portion, once the closure has been removed.

5. An accessory as claimed in claim 4, in which the grate member is an assembly of a grate frame and a grate element.

6. An accessory as claimed in claim 5, in which the grate frame defines an inwardly extending lip on which the grate element is supported, while the grate element defines a shoulder that bears against the lip of the grate frame.

7. The accessory as claimed in claim 1, which is of a plastics material.

8. The accessory as claimed in claim 1, which includes a sealing member having a flange portion and a body portion, the body portion defining a passage in which the conduit is received and the flange portion being positioned to extend radially from the conduit when the conduit is received in the passage, the conduit and the body portion being attachable to a drain pipe positioned in a substructure, with the flange portion overlying an upper surface of the substructure.

9. An accessory as claimed in claim 8, in which the sealing member is of a suitable sealing material such as an elastomeric material.

10. A drainage kit, mountable on a drainage pipe extending above substrate, the kit comprising:

a conduit that has an inlet end portion and an outlet end portion, the outlet end portion being mountable on a drainage pipe so that the conduit and the drainage pipe are in fluid communication with each other, the inlet end portion having an enlarged diameter to define a shoulder at a junction of the inlet and outlet portions so that, when the outlet end portion is mounted within the drainage pipe, the shoulder bears against said substrate, a length of the inlet portion corresponding to a thickness of a screed layer to be formed on the substrate such that the inlet end portion defines a reference level arrangement for the screed layer;

a removable closure member which is mounted on the inlet end portion to close the conduit when not in use so that the ingress of detritus into the drainage pipe is inhibited the inlet end portion and the removable closure member being configured so that, when the closure member is removed, a grate member can be fitted in the resultant opening; and a sealing member having a flange portion and a body portion that defines a passage, the conduit being mountable on the body portion so that the outlet end of the conduit and the passage are in fluid communication with each other.

11. A method of construction comprising:

mounting a conduit on a drainage pipe extending above a substrate, the conduit having an inlet end portion and an outlet end portion so that the conduit and the drainage pipe are in fluid communication with each other, the inlet end portion having an enlarged diameter to define a shoulder at a junction of the inlet and outlet portions so that, when the outlet end portion is mounted on the drainage pipe, the shoulder bears against said substrate, a length of the inlet portion corresponding to a thickness of a screed layer to be formed on the substrate such that the inlet end portion defines a reference level arrangement for the screed layer, the inlet end portion having a removable closure member to close the conduit when not in use so that the ingress of detritus into the drainage pipe is inhibited, the inlet end portion and the removable closure member being configured so that, when the closure member is removed, a grate member can be fitted in the resultant opening;

removing the closure member; and positioning a grate member in the inlet end portion, once the closure member has been removed.

* * * * *

US006799606C1

(12) EX PARTE REEXAMINATION CERTIFICATE (6319th)

United States Patent

Howson

(10) Number: US 6,799,606 C1

(45) Certificate Issued: Jul. 22, 2008

(54) DRAINAGE PIPE COVERING KIT FOR USE DURING BUILDING OR FLOOR CONSTRUCTION

(76) Inventor: Leslie Lawrence Howson, 28 Sunset Boulevard, Surfer's Paradise, Queensland 4217 (AU)

Reexamination Request:
No. 90/008,105, Jul. 12, 2006

Reexamination Certificate for:

| | |
|---|---|
| Patent No.: | **6,799,606** |
| Issued: | **Oct. 5, 2004** |
| Appl. No.: | **10/088,887** |
| Filed: | **Sep. 12, 2002** |

(22) PCT Filed: Sep. 25, 2000

(86) PCT No.: PCT/AW00/01168

§ 371 (c)(1),
(2), (4) Date: Sep. 12, 2002

(87) PCT Pub. No.: WO01/23680

PCT Pub. Date: Apr. 5, 2001

(30) Foreign Application Priority Data

| | | |
|---|---|---|
| Sep. 24, 1999 | (AU) | PQ3083 |
| Nov. 10, 1999 | (AU) | 59308/99 |
| Dec. 8, 1999 | (AU) | PQ4547 |

(51) Int. Cl.

| | |
|---|---|
| ***F16L 57/00*** | (2006.01) |
| ***B65D 59/06*** | (2006.01) |
| ***B65D 59/00*** | (2006.01) |

(52) U.S. Cl. ..... 138/96 R; 138/89; 215/317; 285/4; 4/501; 210/164

(58) Field of Classification Search ..... None
See application file for complete search history.

(56) References Cited

U.S. PATENT DOCUMENTS

| | | | | |
|---|---|---|---|---|
| 2,190,532 A | * | 2/1940 | Lukomski | 210/164 |
| 2,695,678 A | * | 11/1954 | Sisk | 210/165 |
| 4,730,854 A | | 3/1988 | Cuschera | |
| 4,910,811 A | * | 3/1990 | Izzi, Sr. | 4/292 |
| 5,372,715 A | | 12/1994 | Maggard et al. | |

FOREIGN PATENT DOCUMENTS

| | | |
|---|---|---|
| DE | 1281965 | 10/1968 |
| GB | 1014814 | 12/1965 |

* cited by examiner

*Primary Examiner*—Aaron J. Lewis

(57) ABSTRACT

An accessory for use in construction includes a conduit (12) that has an inlet end (34) portion and an outlet end (18) portion. The outlet end (18) portion is mountable on a drainage pipe (22) so that the conduit (12) and the drainage pipe (22) are in fluid communication with each other. A removable closure member (40) is mounted on the inlet end (34) portion to close the conduit (12) when not in use or during building construction, so that ingress of material or detritus into the drainage pipe (22) is inhibited.

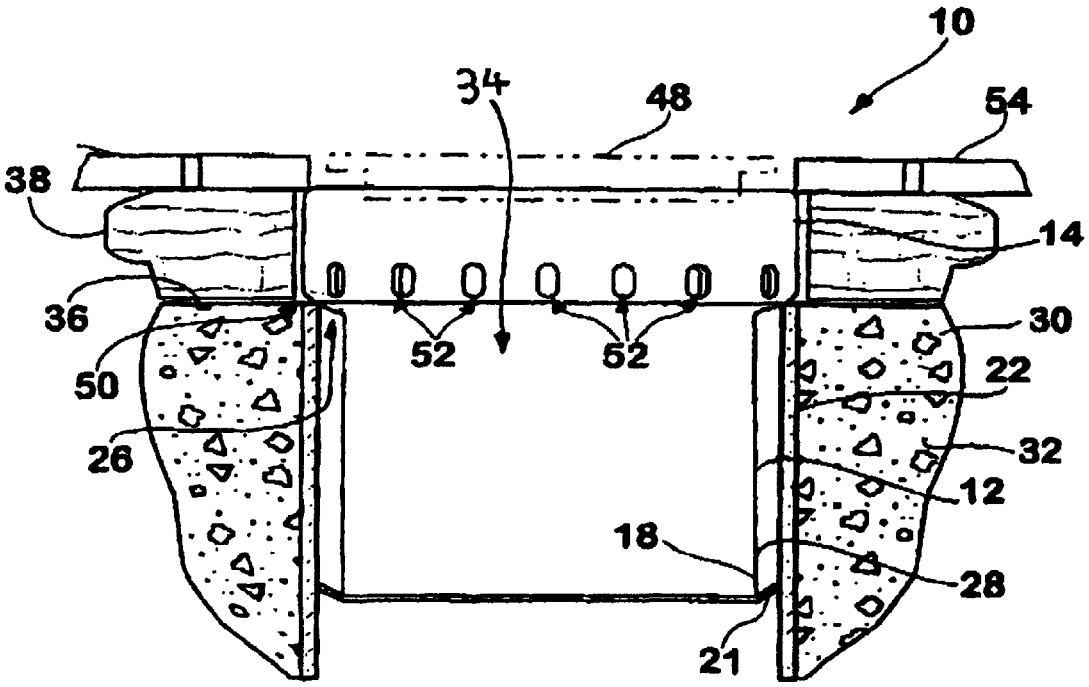

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 10 is confirmed.

Claim 8 is cancelled.

Claims 1, 9 and 11 are determined to be patentable as amended.

Claims 2–7, dependent on an amended claim, are determined to be patentable.

1. An accessory for use in construction, and mountable on a drainage pipe extending above a substrate, the accessory comprising:

a conduit that has an inlet end portion and an outlet end portion, the outlet end portion being mountable on a drainage pipe so that the conduit and the drainage pipe are in fluid communication with each other, the inlet end portion having an enlarged diameter to define a shoulder at a junction of the inlet and outlet portions so that, when the outlet end portion is mounted on the drainage pipe, the shoulder bears against said substrate, a length of the inlet portion corresponding to a thickness of a screed layer to be formed on the substrate such that the inlet end portion defines a reference level arrangement for the screed layer; [and]

a removable closure member which is mounted on the inlet end portion to close the conduit when not in use so that the ingress of detritus into the drainage pipe is inhibited, the inlet end portion and the removable closure member being configured so that, when the closure member is removed, a grate member can be fitted in the resultant opening*; and*

*a sealing member having a flange portion and a body portion, the body portion defining a passage in which the conduit is received and the flange portion being positioned to extend radially from the conduit when the conduit is received in the passage, the conduit and the body portion being attachable to a drain pipe positioned in a substructure, with the flange portion overlying an upper surface of the substructure.*

9. An accessory as claimed in claim [8] *1*, in which the sealing member is of a suitable sealing material such as an elastomeric material.

11. A method of construction comprising:

*mounting a sealing member having a flange portion and a body portion* on a drainage pipe extending above *an upper surface of* a substrate, *the body portion defining a passage in which a conduit is received and the flange portion being positioned to extend radially from the conduit when the conduit is received in the passage, with the flange portion overlying the upper surface;* mounting the conduit having an inlet end portion and an outlet end portion so that the conduit and the drainage pipe are in fluid communication with each other, the inlet end portion having an enlarged diameter to define a shoulder at a junction of the inlet and outlet portions so that, when the outlet end portion is mounted on the drainage pipe, the shoulder bears against said substrate, a length of the inlet portion corresponding to a thickness of a screed layer to be formed on the substrate such that the inlet end portion defines a reference level arrangement for the screed layer, the inlet end portion having a removable closure member to close the conduit when not in use so that the ingress of detritus into the drainage pipe is inhibited, the inlet end portion and the removable closure member being configured so that, when the closure member is removed, a grate member can be fitted in the resultant opening;

removing the closure member; and positioning a grate member in the inlet end portion, once the closure member has been removed.

* * * * *